US007950185B2

(12) United States Patent
Lefevre et al.

(10) Patent No.: US 7,950,185 B2
(45) Date of Patent: May 31, 2011

(54) WINDOW REGULATOR AND METHOD OF ASSEMBLY OF A WINDOW REGULATOR

(75) Inventors: Francois Lefevre, Ardon (FR); Eric Simonneau, Orleans (FR); Michel Mounie, Saint Florent le Jeune (FR); Nicolas Galliot, Sully sur Loire (FR); Francois-Paul Meurou, Sceaux du Gatinais (FR); Jacky Mercier, Bonnee (FR); Franck Corgier, Aubigny sur Nere (FR)

(73) Assignee: Arvinmeritor Light Vehicle Systems—France (FR)

( * ) Notice: Subject to any disclaimer, the term of this patent is extended or adjusted under 35 U.S.C. 154(b) by 1175 days.

(21) Appl. No.: 11/653,069

(22) Filed: Jan. 12, 2007

(65) Prior Publication Data

US 2007/0163178 A1 Jul. 19, 2007

(30) Foreign Application Priority Data

Jan. 13, 2006 (FR) ..... 06 00308

(51) Int. Cl.
*E05F 11/48* (2006.01)

(52) U.S. Cl. ..... 49/352; 49/349; 49/502

(58) Field of Classification Search ..... 49/348, 49/349, 352, 502
See application file for complete search history.

(56) References Cited

U.S. PATENT DOCUMENTS

| | | | | |
|---|---|---|---|---|
| 2,987,937 | A * | 6/1961 | Sala | 74/505 |
| 5,074,077 | A * | 12/1991 | Toyoshima et al. | 49/352 |
| 5,505,022 | A * | 4/1996 | Shibata et al. | 49/352 |
| 5,581,952 | A * | 12/1996 | Kapes et al. | 49/502 |
| 5,778,600 | A * | 7/1998 | Chu | 49/352 |
| 5,960,588 | A | 10/1999 | Wurm et al. | |
| 6,088,965 | A * | 7/2000 | Fukumoto et al. | 49/352 |
| 6,115,966 | A | 9/2000 | Shibata | |
| 6,141,910 | A | 11/2000 | Kobrehel et al. | |
| 6,256,929 | B1 * | 7/2001 | Serrano et al. | 49/352 |
| 6,910,730 | B2 * | 6/2005 | Kinoshita et al. | 296/146.16 |
| 7,044,412 | B2 * | 5/2006 | Hemond et al. | 242/390.8 |
| 7,150,493 | B2 * | 12/2006 | Kinoshita et al. | 296/146.2 |
| 7,591,104 | B2 * | 9/2009 | Takeda et al. | 49/352 |
| 2003/0160124 | A1 | 8/2003 | Hemond et al. | |
| 2005/0016069 | A1 * | 1/2005 | Doux et al. | 49/352 |

FOREIGN PATENT DOCUMENTS

| | | | |
|---|---|---|---|
| DE | 19756668 | | 2/1999 |
| DE | 10162036 | C1 * | 1/2003 |
| DE | 10221361 | | 11/2003 |
| EP | 1170452 | | 1/2002 |
| FR | 2761104 | | 9/1998 |
| FR | 2773582 | | 7/1999 |
| FR | 2857908 | | 1/2005 |

OTHER PUBLICATIONS

French Search Report dated Oct. 13, 2006.

* cited by examiner

*Primary Examiner* — David Dunn
*Assistant Examiner* — David E Allred
(74) *Attorney, Agent, or Firm* — Cantor Colburn LLP

(57) ABSTRACT

A window regulator device includes a rail having at least one projecting lug, a plate having at least one lug, a drive cable, and a cable drum placed in a recess of the plate. The plate is fixed to the rail by a joint action of a tensioned drive cable and the mutual imbrication of the lugs of the plate and the rail. The assembly of the window regulator device is simplified, and the drum can be fixed independently of the mounting and removal of an actuation motor.

16 Claims, 3 Drawing Sheets

WINDOW REGULATOR AND METHOD OF ASSEMBLY OF A WINDOW REGULATOR

REFERENCE TO RELATED APPLICATION

This application claims priority to French Patent Application FR 06 00 308 filed on Jan. 13, 2006.

BACKGROUND OF THE INVENTION

This invention relates generally to a window regulator device for a vehicle opening frame and a method of assembling the window regulator device.

A window regulator is a device used in a motor vehicle opening frame equipped with a window to transmit a driving force exerted by a user or a motor to the window.

Vehicle door window regulators are described, for example, in documents FR-A-2 761 104, U.S. Pat. Nos. 6,141,910, 5,960,588 or 6,115,966. A window regulator generally includes a motor or a crank that drives a drum by a gear system. The drum drives a cable that acts on a slider secured to the window along at least one rail.

The gear system and the drum are generally arranged in a housing for ease of handling and to protect the window regulator. The housing containing the drum and the gear system can also include the motor and an electronic unit, or can include apertures for modular assembly with such components. A housing of this kind is described, for example, in documents U.S. Pat. Nos. 6,141,910 or FR-A-2 857 908.

When the window regulator is assembled, the rail or rails, the drive cable, the drum, the actuation motor or the crank, and if applicable the electronic unit, must be securely fixed in a door of a vehicle. All or some of the components of the window regulator can be pre-assembled on a carrier plate. For example, document FR-A-2 857 908 describes a carrier plate that brings together the drum on one side and the motor and the electronic unit on the other side. The carrier plate is then inserted in the door of the motor vehicle. Document U.S. Pat. No. 5,960,588 also describes a carrier plate that brings the drum and the motor together on the same side. The carrier plate is then fixed on an interior panel of the door. The carrier plate simplifies the final assembly of the window regulator in the door, but is bulky and relatively costly.

The window regulator can also be fixed on a panel that is then set into a structure of the door. The panel can be denoted by the term "door module," and in addition to the window regulator components, can carry other door accessories, such as, for example, a loudspeaker or a lock. The panel of the door module must have good rigidity, in particular due to the tension of the cables, but especially when the window regulator is manually driven by the crank. The stresses applied to the crank, in particular at a limit stop, can be considerable and are passed on to the panel (with the risk of its deformation if it is too flexible), whether the panel is metal or plastic.

Alternatively, the drum housing, with or without the crank or the actuation motor and the electronic unit, can be fixed in the door after insertion of the rails and the drive cable. Each component is then fixed separately in the door, and the cable tension is then adjusted to drive the window accurately. Separate fixing of each component of the window regulator provides flexibility and adaptation to different layouts and door shapes, but complicates the final assembly of the window regulator in the door.

There is therefore a need for a simplified and low cost window regulator device that allows for good rigidity without making the panel too heavy if the window regulator is assembled on a door module panel.

Furthermore, in operation, when the window regulator is incorporated into a vehicle door, it can be necessary to change or repair the actuation motor and/or the electronic unit. When the actuation motor is removed, it is preferable for the drum to be kept in place and for the drive cable tension not to be released. If the cable tension is released, the cable can escape from its guide points, and the position of the window slider or sliders can become un-adjusted, making reassembly very complex. It is then necessary to readjust the settings for all the components of the window regulator.

There is also therefore a need for a window regulator device that allows for the removal of the actuation motor and the electronic unit without requiring the removal of the other components of the window regulator, particularly by maintaining the drum and the drive cable in position.

SUMMARY OF THE INVENTION

The invention provides a window regulator device assembled by placing a cable drum in a recess of a plate and securing the plate against a rail by the joint action of cable tension and mutual imbrication of lugs located, respectively, on the plate and on the rail. The assembly of the window regulator device can be simplified, and the cable drum is fixed independently of the mounting and removal of an actuation motor. Moreover, by fixing the plate on the rail, the rigidity of the rail can be taken advantage of when the window regulator is assembled on a door module panel. The door module panel does not need to be perfectly rigid because the stresses applied to the crank are partially absorbed by the rail and not by the panel alone, reducing the cost of the door module panel.

More particularly, the invention provides a window regulator device including at least one rail having at least one lug that projects from the rail, a plate having at least one lug and a recess, a drive cable, and a cable drum placed in the recess of the plate. The plate is fixed to the rail by the joint action of the tensioned cable and the mutual imbrication of the lugs of the plate and the rail.

Depending on the embodiment, the cable drum can be held in the recess of the plate by the lug of the rail, or the rail can have at least one cut-out that isolates the lug of the rail. The rail can have at least one aperture that receives the lug of the plate, or the plate can include at least one slot to receive the lug of the rail.

According to one embodiment, the window regulator device further includes an actuation motor fixed to the plate that engages with the drum. According to one characteristic, at least one fixing point of the actuation motor on the plate is located on the rail.

The invention also provides a door module including a panel, at least one rail fixed to the panel and having at least one lug that projects from the rail, a plate having at least one lug and a recess, a drive cable, and a cable drum placed in the recess of the plate. The plate is fixed to the rail by the joint action of the tensioned cable and the mutual imbrication of the lugs of the plate and the rail.

The invention further provides a vehicle opening frame including a window actuated by a window regulator device according to the invention.

The invention also relates to a method of assembling a window regulator device. The method includes the steps providing a rail with at least one lug that projects from the rail, placing a cable drum in a recess of a plate having at least one lug, securing the plate on the rail by the mutual imbrication of the lugs of the plate and the rail, positioning a drive cable along a cable run running from the cable drum, and tensioning the drive cable to immobilize the plate against the rail.

According to one characteristic, the method of assembling further includes a step of fixing an actuation motor onto the plate.

The invention further relates to a method of removing the actuation motor for the window regulator device according to the invention. The method includes the steps of releasing the actuation motor from the plate and maintaining the tension of the drive cable with the drum held in the recess of the plate by the lug of the rail.

BRIEF DESCRIPTION OF THE DRAWINGS

Other characteristics and advantages of the invention will become apparent on reading the following detailed description of the embodiments of the invention, given as an example only and with reference to the drawings, which show.

DETAILED DESCRIPTION OF THE PREFERRED EMBODIMENT

A direction X, which is a direction of travel of the vehicle, a direction Z (vertical) and a direction Y (lateral and perpendicular to the X and Z axes) are defined conventionally.

Figure 1:
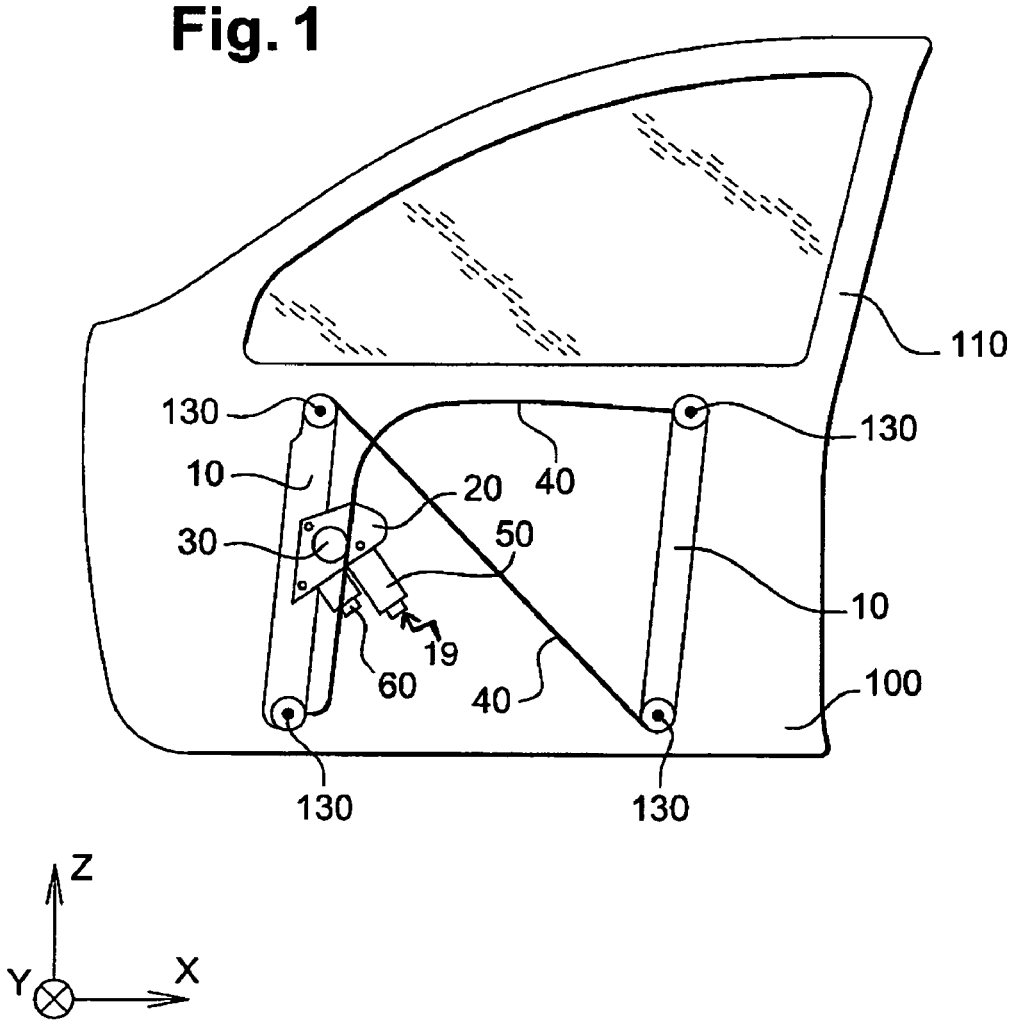
FIG. 1 illustrates a schematic view of a vehicle door including a window regulator device according to one embodiment of the invention.

FIG. 1 shows a schematic view of a motor vehicle door including a window regulator device 19 according to the invention. FIG. 1 is a view in the plane (X, Z) of a body of a vehicle. FIG. 1 shows a door shell 100 with a window frame 110. A window is adapted to slide between a closed position in which the window fills the window frame 110 and an open position in which the window is completely housed in the door shell 100. The window regulator device 19 drives the window between the closed position and the open position. Sliders attached to the window slide on guide rails 10. Depending on the model of the vehicle, the door can include two guide rails 10 equipped with sliders or a single guide rail 10 together with a window guide. Two guide rails 10 are illustrated in FIG. 1, although this embodiment does not limit the invention.

A drive cable 40 winds and unwinds on a cable drum 30 engaged by an electric drive motor 50. Generally, an electronic unit 60 is associated with the drive motor 50 to control, among other things, the speed and direction of rotation of the drive motor 50. The cable drum 30 can also be driven by a crank.

The drive cable 40 is tensioned along a cable run defined by a set of deflecting pulleys 130 between ends of the guide rails 10 and the cable drum 30. The tension of the drive cable 40 must be controlled accurately. Excess tension prematurely wears the components of the window regulator device 19, which can result in breakage. Insufficient tension in the drive cable 40 allows play, which falsifies the calculation of the exact position of the window by the electronic unit and can result in the malfunction of certain applications, such as anti-pinch, for example. Insufficient tension in the drive cable 40 can also cause the drive cable 40 to come loose from the deflecting pulleys 130. The tension of the drive cable 40 is adjusted at the time of assembly of the window regulator device 19 in the door when the relative positioning of the cable drum 30 and the guide rails 10 is fixed. The cable drum 30 is fixed onto a plate 20 secured to the guide rail 10, and the drive cable 40 is tensioned along the cable run.

Figure 2:
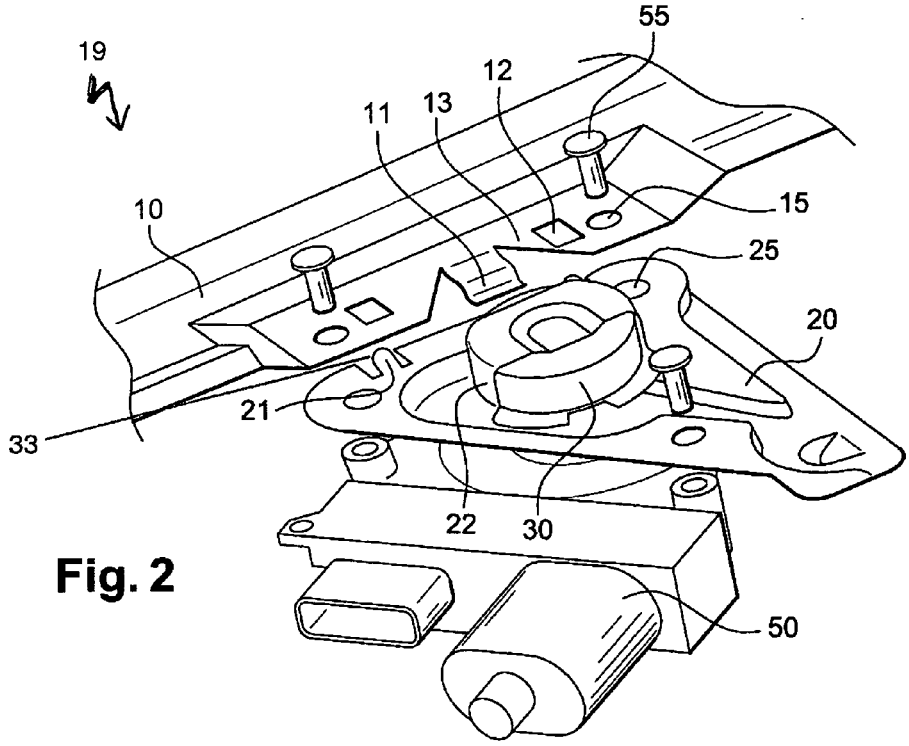
FIG. 2 illustrates a schematic exploded perspective view of the window regulator device according to the invention.
Figure 3:
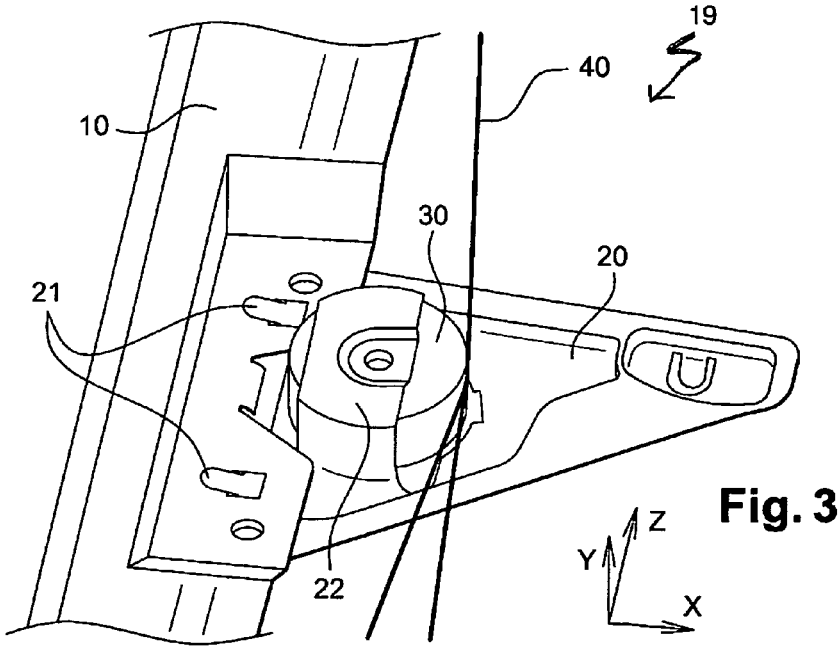
FIG. 3 illustrates a schematic perspective top view of a plate secured to a rail of the window regulator device according to the invention.
Figure 4:
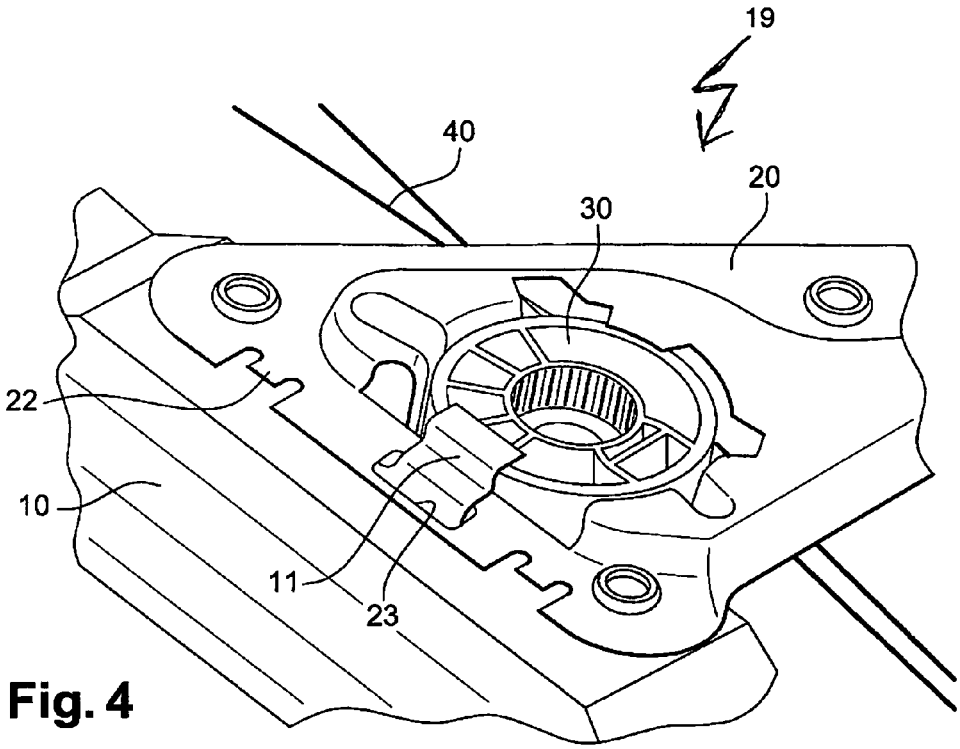
FIG. 4 illustrates a schematic perspective bottom view of the plate secured to the rail of the window regulator device of FIG. 3.

FIG. 2 shows an exploded view of a part of the window regulator device 19, and FIGS. 3 and 4 show in detail the fixing of the cable drum 30 against the guide rail 10 of the window regulator device 19.

FIG. 2 shows the guide rail 10, a plate 20 and the cable drum 30 placed in a recess 22 in the plate 20. The guide rail 10 extends in a longitudinal direction and is approximately aligned with the vertical Z axis when the window regulator device 19 is assembled in the door of the vehicle. The guide rail 10 includes a lug 11 (a projecting lug) isolated by a cut-out 13 provided in an edge of the guide rail 10. According to the embodiment illustrated, the cut-out 13 of the guide rail 10 is shaped like a trapezium, and the lug 11 projects from a short parallel side of the trapezium.

The lug 11 on the guide rail 10 projects diagonally towards both a back and a side of the guide rail 10. With reference to the guide rail 10 in position of the window regulator device 19 assembled in the door, the lug 11 extends in a direction having one X component and one Y component.

According to the invention, the plate 20 is designed to be secured against the guide rail 10. To this end, according to the embodiment illustrated, the plate 20 includes two lugs 21 isolated by two cut-outs 33 in an edge of the plate 20. The two lugs 21 of the plate 20 are designed to enter apertures 12 provided in the guide rail 10 on either side of the lug 11. The apertures 12 for receiving the lugs 21 of the plate 20 are approximately aligned with the short parallel side of the trapezium of the cut-out 13 of the guide rail 10, i.e., with the base of the lug 11 of the guide rail 10. The plate 20 also includes a slot 23 (shown on FIG. 4) designed to receive the lug 11 of the guide rail 10. The slot 23 and the base of the lugs 21 of the plate 20 are approximately aligned.

FIG. 2 also shows the drive motor 50 designed to be fixed to the plate 20 to engage with the cable drum 30. According to one embodiment, the drive motor 50 can be fixed to the plate 20 by three fixing screws 55 distributed on a periphery of a motor housing. The plate 20 includes three screw holes 25. Furthermore, as the plate 20 is secured against the guide rail 10, at least one of the fixing screws 55 can pass through the guide rail 10 and fix the plate 20 against the guide rail 10. The guide rail 10 includes at least one fixing point that is opposite one of the screw holes 25 (fixing points) of the plate 20. In FIG. 2, the fixing point is shown by a screw hole 15.

FIG. 2 shows the guide rail 10. The lug 11 projecting from the guide rail 10, the apertures 12 to receive the lugs 11 of the plate 20, and the screw holes 15, if applicable, (shown in FIG. 2) allow a slider to move along a length of the guide rail 10 without being obstructed by the plate 20 fixed to the guide rail 10.

The window regulator device 19 can be assembled in the following manner. At least one guide rail 10 including the lug 11 is manufactured. The cable drum 30 is placed in the recess 22 of the plate 20 on one of the edges. The drive cable 40 is positioned along a cable run running from the cable drum 30 and extending along the guide rail or rails 10 of the window regulator device 19. The cable run depends on the model of the window regulator device 19.

As illustrated in FIG. 3, the plate 20 is secured to the guide rail 10 by mutual imbrication of the lugs 21 and 11 of the plate 20 and the guide rail 10, respectively. The lug 11 of the guide rail 10 slides into the slot 23 of the plate 20, and the lugs 21 of the plate 20 enter the apertures 12 of the guide rail 10. The lug 11 of the guide rail 10 is then under the plate 20, and the lugs 21 of the plate 20 are on the guide rail 10. These reciprocal insertions (the lug 21 of the guide rail 10 in the slot 23 of the plate 20, and the lugs 21 of the plate 20 in the apertures 12 of the guide rails 10) are possible due to the alignments of the slot 23 and the base of the lugs 21 of the plate 20, and the apertures and the base of the lug 11 of the guide rail 10. The trapezium shape of the cut-out 13 of the guide rail 10 allows the plate 20 to tilt at the time of mutual imbrication of the lugs 11 and 21, allowing the plate 20 to be firmly held against the guide rail 10.

The mutual imbrication allows the plate 20 to be immobilized in two directions, i.e., in the longitudinal direction of the guide rail 10 and in a direction perpendicular to a plane of the guide rail 10. When the guide rail 10 of the window regulator device 19 is fixed in the door of the vehicle, the mutual imbrication of the lugs 21 and 11 of the plate 20 and the guide rail 10, respectively, immobilizes the plate 20 in the directions Z and Y defined above. The plate 20 could, however, be released from the guide rail 10 in the direction X. To immobilize the plate 20 firmly against the guide rail 10, the drive cable 40 is tensioned between the cable drum 30 and at least two deflecting pulleys 130. The number of deflecting pulleys 130 depend on the model of the window regulator device 19. The drive cable 40 tension flattens the plate 20 against the guide rail 10 and blocks the plate 20 in the third direction X to immobilize the plate 20 firmly before the drive motor 50 is installed.

According to the embodiments, the drive cable 40 can be positioned along the cable run before or after the plate 20 has been secured to the guide rail 10 by mutual imbrication of the lugs 21 and 11 of the plate 20 and the guide rail 10, respectively. For example, a jig can hold the plate 20 and the guide rail 10 together before the installation and tensioning of the drive cable 40.

As illustrated in FIG. 4, the fixing of the plate 20 to the guide rail 10 further allows the cable drum 30 to be held in the recess 22 of the plate 20. The lug 11 of the guide rail 10 slides in the slot 23 of the plate 20 to pass under the plate 20. The lug 11 of the guide rail 10 is sufficiently long to extend above the opening of the recess 22 of the plate 20. The cable drum 30, placed in the recess 22 of the plate 20, can therefore rotate freely in the recess 22, but is blocked in translation by the base of the recess 22 and by the lug 11 of the guide rail 10. Thus, when the drive motor 50 is fixed to the plate 20, the cable drum 30 can be engaged to move the drive cable 40. When the drive motor 50 is not yet fixed or has been removed from the plate 20, the cable drum 30 is held in place in the recess 22 of the plate 20.

The lug 11 of the guide rail 10 can have a hook shape, with a first part designed to be flattened against an edge of the slot 23 of the plate 20 and a second part designed to hook an edge of the cable drum 30. The hook shape of the lug 11 of the guide rail 10 allows the plate 20 to be held firmly against the guide rail 10 (by the first part), while simultaneously the cable drum 30 is securely held in the recess 22 of the plate 20 (by the second part).

The drive motor 50 can then be fixed to the plate 20 by screwing or any other suitable method. At least one of the fixing screws 55 can fix the plate 20 to the guide rail 10, even if the plate 20 is already firmly held against the guide rail 10 by the joint action of the tensioned drive cable 40 and the mutual imbrication of the lugs 21 and 11 of the plate 20 and the guide rail 10, respectively.

The window regulator device 19 can be assembled with the plate 20 fixed to the guide rail 10 by the joint action of the tensioned drive cable 40 and the mutual imbrication of the lugs 21 and 11 of the plate 20 and the guide rail 10, respectively. The window regulator device 19 thus assembled can be delivered to the manufacturer to be assembled in the vehicle door. The drive motor 50 can be delivered and assembled separately. The assembly of the window regulator device 19 in a vehicle door is thus simplified.

Figure 5:
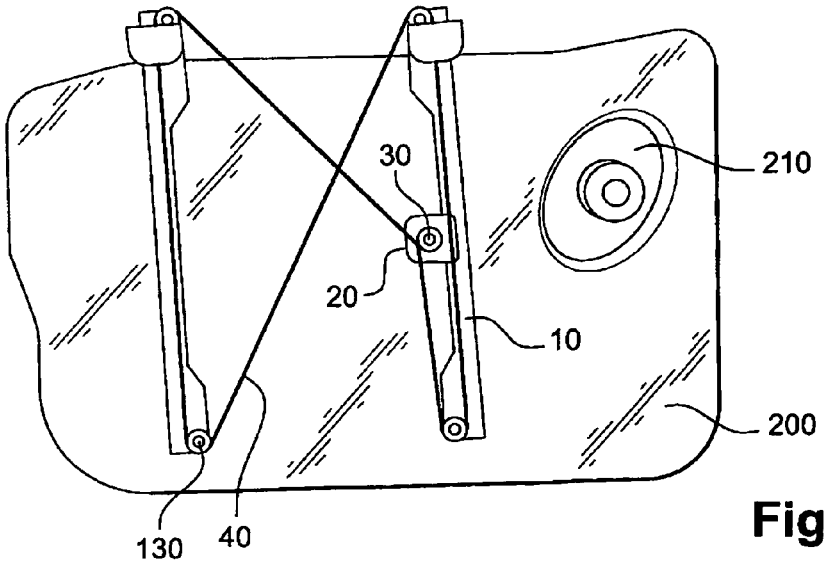
FIG. 5 illustrates a view of the window regulator device mounted on a panel before assembly in the door.

As illustrated in FIG. 5, the window regulator device 19 can also be assembled on a door module panel 200. The door module panel 200 can be made from molded plastic or metal and generally includes a member to receive and to attach different door accessories, for example a loudspeaker 210.

FIG. 5 illustrates a manually driven embodiment of the window regulator device 19. At least one guide rail 10 having the lug 11 is fixed to the door module panel 200, for example by screwing. The plate 20 receiving the cable drum 30 is then fixed to the guide rail 10 by the joint action of the tensioned drive cable 40 and the mutual imbrication of the lugs 21 and 11 of the plate 20 and the guide rail 10, respectively, as described above. The door module panel 200 thus assembled can be delivered to the manufacturer to be mounted in the vehicle door. In operation, the stresses applied to the crank by the user, in particular at the limit stop, are distributed on the guide rail 10 and the door module panel 200 as the plate 20 that supports the cable drum 30 is fixed to the guide rail 10 and to the door module panel 200. After the mutual imbrication of the lugs 21 and 11 of the plate 20 and the guide rail 10, respectively, two screws can fix the plate 20 to the guide rail 10, and a screw can connect the plate 20 to the door module panel 200. The door module panel 200 can thus be made lighter to reduce its cost, without affecting the solidity of the window regulator device 19.

Furthermore, in the case of an electrically driven window regulator device 19, the drive motor 50 of the window regulator device 19 according to the invention can also be removed without the need to remove the cable drum 30 at the same time and without releasing the tension in the drive cable 40. As illustrated in FIG. 4, the drive motor 50 can be removed from the plate 20, for example by unscrewing the three fixing screws 55, without altering the position of the cable drum 30. The cable drum 30 is held in position in the recess 22 of the plate 20 fixed to the guide rail 10 as explained above. The tension of the drive cable can thus be maintained during the time needed to work on the drive motor 50 of the window regulator device 19, and there is no need for readjustment of the drive cable 40 tension. The cost of repair and maintenance of the window regulator device 19 is thus reduced.

Of course, this invention is not limited to the embodiments described as examples with reference to the figures. In particular, although the invention has been illustrated with only one lug 11 projecting on the guide rail 10 and two lugs 21 on the plate 20, it is understood that the number, shapes and locations of the lugs 11 and 21 of the guide rail 10 and of the plate 20, respectively, can vary while performing the fixing of the plate 20 to the guide rail 10 by the joint action of the mutual imbrication of the lugs 11 and 21 and the tension in the drive cable 40.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A window regulator device comprising:

at least one rail including at least one rail lug that projects from the at least one rail, the at least one rail defining a first direction;

a plate including at least one plate lug and a recess;

a tensioned drive cable; and a cable drum placed in the recess of the plate, wherein the plate is firmly held flat and fixed to the at least one rail by joint action of the tensioned drive cable and mutual imbrication of the at least one plate lug and the at least one rail lug, the mutual imbrication immobilizing the plate in the first direction and in a second direction perpendicular to the first direction, and the tension of the tensioned drive cable blocking the plate in a third direction that is perpendicular to the first direction and the second direction;

wherein the imbrication comprises the rail lug projecting in the third direction through a slot in the plate.

2. The window regulator device of claim 1, wherein the cable drum is held in the recess of the plate by the at least one rail lug.

3. The window regulator device of claim 1, wherein the at least one rail includes at least one cut-out that isolates the at least one rail lug.

4. The window regulator device of claim 1, wherein the at least one rail includes at least one hole to receive the at least one plate lug.

5. The window regulator device of claim 1, wherein the plate includes at least one slot to receive the at least one rail lug.

6. The window regulator device of claim 1, further including an actuation motor fixed to the plate that engages the cable drum.

7. The window regulator device of claim 6, wherein the actuation motor is fixed to the plate at a fixing point, and wherein the fixing point is located on the at least one rail.

8. A door module comprising:

a panel;

at least one rail fixed to the panel and including at least one rail lug that projects from the at least one rail;

a plate including at least one plate lug and a recess;

a tensioned drive cable; and a cable drum located in the recess of the plate, wherein the plate is firmly held flat and fixed to the at least one rail by joint action of the tensioned drive cable and mutual imbrication of the at least one plate lug and the at least one rail lug, the mutual imbrication immobilizing the plate in a first direction and in a second direction perpendicular to the first direction, and the tension of the tensioned drive cable blocking the plate in a third direction that is perpendicular to the first direction and the second direction;

wherein the imbrication comprises the rail lug projecting in the third direction through a slot in the plate.

9. A vehicle opening frame, a vehicle defining a direction of travel, a vertical direction perpendicular to the direction of the travel and a lateral direction perpendicular to the direction of travel and to the vertical direction, the vehicle opening frame comprising:

a window regulator device including:

at least one rail having at least one rail lug that projects from the at least one rail, the at least one rail extending in the vertical direction of the vehicle, a plate having at least one plate lug and a recess, a tensioned drive cable, and a cable drum placed in the recess of the plate, wherein the plate is firmly held flat and fixed to the at least one rail by joint action of the tensioned drive cable and mutual imbrication of the at least one plate lug and the at least one rail lug; and a window actuated by the window regulator device, the mutual imbrication immobilizing the plate in the vertical direction and in the lateral direction, and the tension of the tensioned drive cable blocking the plate in the direction of travel;

wherein the imbrication comprises the rail lug projecting in the third direction through a slot in the plate.

10. The door module of claim 8, wherein the cable drum is held in the recess of the plate by the at least one rail lug.

11. The door module of claim 8, wherein the at least one rail includes at least one cut-out that isolates the at least one rail lug, the at least one cut-out of the rail is shaped like a trapezium, and the lug projects from a short parallel side of the trapezium.

12. The vehicle opening frame of claim 9, wherein the cable drum is held in the recess of the plate by the at least one rail lug.

13. The vehicle opening frame of claim 9, wherein the at least one rail includes at least one cut-out that isolates the at least one rail lug, the at least one cut-out of the rail is shaped like a trapezium, the lug projects from a short parallel side of the trapezium.

14. The window regulator device of claim 3, wherein the at least one cut-out of the rail is shaped like a trapezium, and the lug projects from a short parallel side of the trapezium.

15. A window regulator device comprising:

at least one rail including at least one rail lug that projects from the at least one rail;

a plate including at least one plate lug and a recess;

a tensioned drive cable;

a cable drum placed in the recess of the plate, wherein the plate is fixed to the at least one rail by joint action of a tensioned drive cable and mutual imbrication of the at least one plate lug and the at least one rail lug, and the at least one rail lug holding the cable drum in the recess of the plate.

16. The window regulator device of claim 15, wherein the at least one rail includes at least one cut-out that isolates the at least one rail lug, the at least one cut-out of the at least one rail is shaped like a trapezium, and the lug projects from a short parallel side of the trapezium.

* * * * *